US005100516A

United States Patent [19]

Nishimura et al.

[11] Patent Number: 5,100,516

[45] Date of Patent: Mar. 31, 1992

[54] HIGH VOLUME WORKPIECE HANDLING AND CHEMICAL TREATING SYSTEM

[75] Inventors: Kazuyuki Nishimura; Hirohiko Ikegaya, both of Iwata, Japan

[73] Assignee: Yamaha Hatsudoki Kabushiki Kaisha, Japan

[21] Appl. No.: 468,947

[22] Filed: Jan. 23, 1990

[30] Foreign Application Priority Data

Jan. 25, 1989 [JP] Japan ..... 1-15767

[51] Int. Cl.[5] ..... C25D 5/04; C25D 5/24; B65G 25/02; B65G 49/04; B66C 17/08

[52] U.S. Cl. ..... 205/145; 204/198; 414/155; 414/222; 205/210

[58] Field of Search ..... 134/66, 76; 414/155, 414/222; 901/6; 204/23, 32.1, 198

[56] References Cited

PUBLICATIONS

Appenzeller et al., "Automated Transport and Handling System for the Processing of Parts Through a Manufacturing Line", IBM Technical Disclosure Bulletin, vol. 23, No. 6, Nov. 1980.

*Primary Examiner*—John F. Niebling

*Assistant Examiner*—Kishor Mayekar

*Attorney, Agent, or Firm*—Bacon & Thomas

[57] ABSTRACT

A high volume workpiece treating system includes horizontally arranged treating staions, including vertically arranged treating stations. A conveyor system moves workpieces sequentially and cyclically through the vertically arranged treating stations so that, while one treating station is loaded with workpieces and carrying out a treating procedure, the next station in the vertical group is being loaded with the next batch of workpieces. A single conveyor is arranged to supply a group of vertical treating stations with workpieces and to remove the workpieces from each station at the completion of the treating process. The conveyor and treating stations are arranged to handle sequential batches of workpieces with a minimum of idle time to achieve maximum efficiency. Each group of vertical treating stations is associated with a single piece of auxiliary equipment that controls the flow of treating solution through each of the treating cells of the group. A workpiece handling procedure governs movement of the conveyor and opening and closing of the treating stations in a continuous process.

24 Claims, 5 Drawing Sheets

HIGH VOLUME WORKPIECE HANDLING AND CHEMICAL TREATING SYSTEM

BACKGROUND OF THE INVENTION

1. Field of the Invention

This invention relates to chemical surface treating systems for workpiece articles and a handling system for such workpieces.

2 Related Technology

This invention is an improvement in closed cell, electrolytic plating systems wherein individual workpieces are placed within a closed cell and immersed in an electrolytic solution circulated through the cell while a potential is applied between the workpiece and the cell wall to achieve electrolytic plating. In accordance with prior art systems, when a plurality of workpieces were to be treated, they were all immersed in an electrolytic bath and plated simultaneously. This method had the advantage that large numbers of workpieces could be treated simultaneously; however, the system inherently presented environmental problems in that the movement of the workpieces into and out of the baths created spillage and splashing of the electrolytic solution and other problems.

An initial improvement in the prior art to the bath plating process was the use of closed cells for electrolytically plating individual workpieces within a closed chamber through which electroplating solution was pumped. The disadvantage of this system is that it is difficult to achieve high volume throughput of workpieces due to the need to sequentially open and close the cells and sequentially circulate electrolytic solution therethrough.

It is thus highly desirable to achieve closed cell electrolytic plating of workpieces while enabling a high volume of workpieces to be processed through the system.

SUMMARY OF THE INVENTION

This invention constitutes an arrangement for high volume electroplating of individual workpieces in multiple electrolytic plating cells. This is achieved by using a combination of vertically and horizontally arranged treating stations for workpieces that are moved into and out of the stations by an automated conveyor system. Multiple treating stations are provided along a processing route and individual workpieces are conveyed to each station along the route. The treating stations include vertically arranged stations each having multiple treating cells in generally horizontal alignment. Each group of vertical treating stations is associated with a single workpiece conveyor that sequentially and cyclically moves workpieces from a supply location to each of the individual vertical treating stations. While one of the vertical treating stations is processing and treating a workpiece, the conveyor moves a successive workpiece or batch of workpieces to the next idle treating station of the same group and thereafter returns to the previous treating station to remove workpieces therefrom at the conclusion of their treating process. The conveyor system is also arranged to move to a subsequent treating station, for example a water bath rinsing station, whereat the workpieces may be deposited individually or in batches.

Thus, a single conveyor is arranged to move along a predetermined cyclic pattern that includes picking up workpieces at a supply location, delivering them to each of the vertically arranged treating stations in a single group and then moving workpieces from the individual treating stations to a subsequent treating station, all in a continuous procedure that minimizes idle time of the treating stations.

A further feature of the invention is the utilization of supporting equipment for the treating stations, in particular the multiple vertical arranged treating stations, whereby a single supply tank associated with pumps and controls is capable of supplying treating solution to the treating cells of the treating stations on a station-by-station basis, thereby minimizing the quantity of treating solution required and the associated pumping, valving, conduit and control systems that otherwise would be required if each treating station utilized its own electrolytic supply system.

This unique arrangement of treating cells, conveyor system and support system results in an efficient, high volume workpiece handling and treating system involving closed cell treatment of individual workpieces.

BRIEF DESCRIPTION OF THE DRAWINGS

With reference to the drawings appended hereto.

DETAILED DESCRIPTION OF PREFERRED EMBODIMENT OF THE INVENTION

Figure 1:
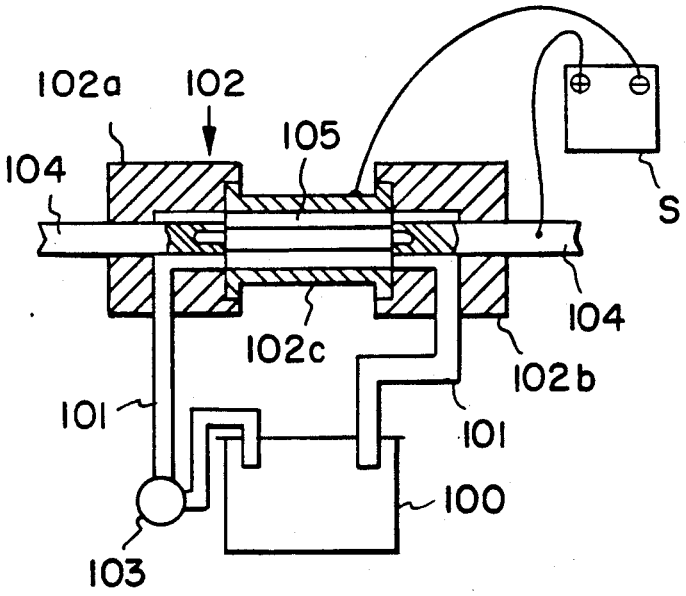
FIG. 1 PRIOR ART
FIG. 1 schematically illustrates a prior art electrolytic cell system for plating metal surfaces.

The present invention is concerned with a high volume workpiece handling and treating system that has particular application in closed cell electrolytic plating of metal workpieces. With reference to the drawings, FIG. 1 shows a typically prior art electrolytic plating cell including an electrolytic solution supply tank 100 communicating via pump 103 and conduits 101 with an electrolytic plating cell 102 formed of axially arranged cell components 102*a*, 102*b* and 102*c* forming a closed treating cell. A workpiece 105 to be plated in the electrolytic cell 102 is positioned and maintained within the cell by chuck elements 104. The workpiece is plated when electrolytic solution is placed with the electrolytic cell 102 and an electrical potential is applied from electrical source S to the chuck 104 and a component 102*c* of the cell 102.

In accordance with the prior art apparatus and process, it is very difficult to process a large volume of work at any one given time in a closed cell system. It is evident that the electrolytic cell must be opened and closed sequentially in order to receive and process individual workpieces and the electrolytic solution must be periodically supplied to and drained from each electrolytic cell.

It is known in the prior art to utilize multiple closed treating cells in a treating station for workpieces that may be loaded simultaneously by an appropriate conveyor or workpiece handling system. However, since each workpiece is processed in its own treating cell, as the number of cell lines is increased to accommodate the workpieces, there is a corresponding increase in the amount of auxiliary equipment needed to support the treating cells (i.e., liquid tanks, conduit, pumps, motors, etc.). Moreover, while conveyor systems are utilized for moving workpieces into and out of the treating cells, including multiple conveyors, a problem is usually encountered in that considerable idle time of the treating cells results during the movement of workpieces out of the treating cells at the completion of a treating process, picking up the next batch of workpieces and conveying them to the idle row of treating cells. This results in inefficiency and limits high volume processing of workpieces.

It is thus highly desirable to improve efficiency of processing a high volume of workpieces to be surface treated such as by an electrolytic plating process by using multiple electrolytic cells arranged in vertical and horizontal order to enable multiple cells to be loaded with workpieces and then unloaded in rapid sequence.

Figure 2:
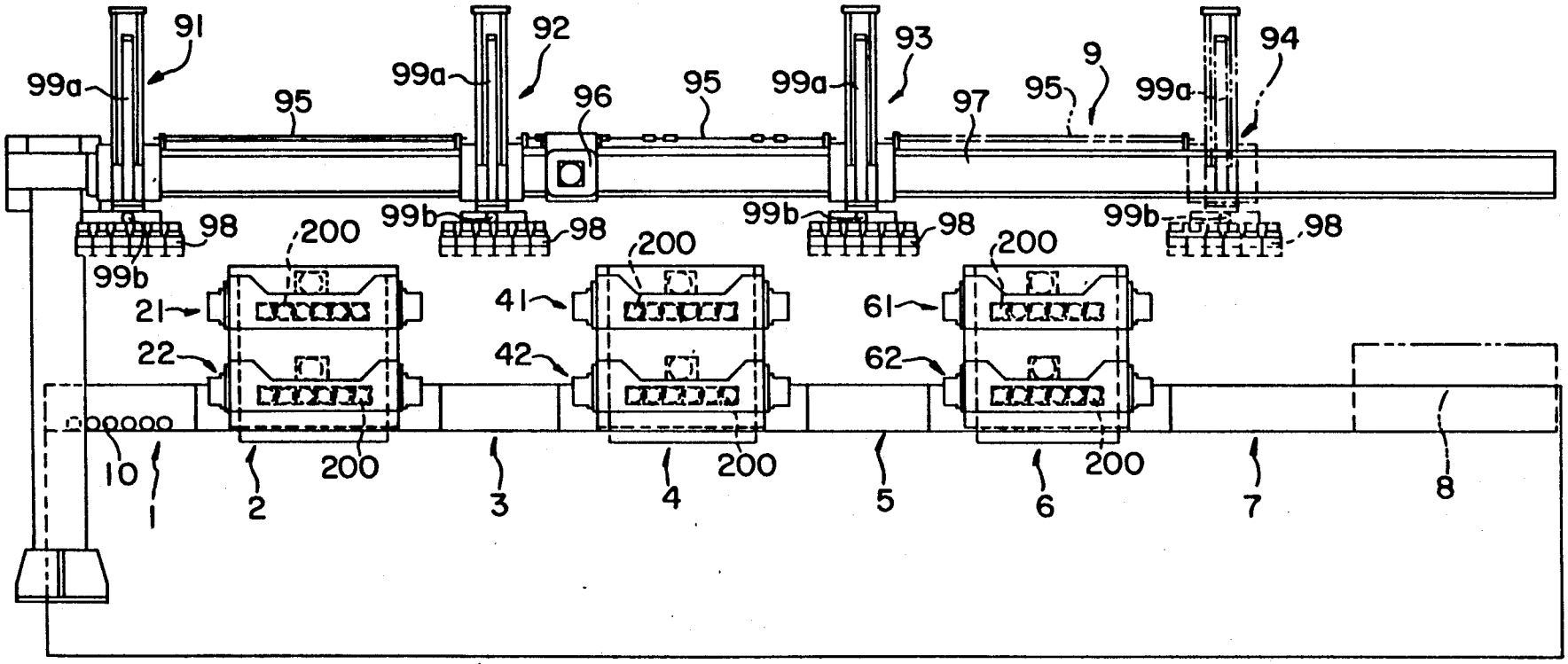
FIG. 2 is a side elevation view of a high volume workpiece handling and treating system embodying this invention.

In accordance with the present invention, and with reference to FIG. 2, a high volume workpiece handling and treating system is illustrated, and includes work handling and treating stations 1–8. Station 1 comprises a workpiece supply station whereat multiple workpieces 10 are held in preparation for conveyance to treating stations 2–8 by an overhead conveyor system 9 in a manner to be described below.

Treating station 2 is a degreasing station and includes a plurality of vertically spaced treating stations 21,22 for workpieces 10. As illustrated, each treating station 21,22 may accommodate and treat six workpieces 10 simultaneously within treating cells 200 through which or to which liquid chemical solution is circulated by means of auxiliary equipment 220 (see FIG. 3) via appropriate inlet and outlet conduit connections (not illustrated) connected to the cells. The auxiliary equipment 220 for the treating stations 21,22 would include a liquid solution holding tank, conduits, valves, pumps, control apparatus and the like for ensuring that the treating cells 21,22 are sequentially provided with appropriate treating solution at the appropriate time during each treating procedure for workpieces 10. As will be noted below, the workpieces 10 are placed in the treating stations 21,22 in a sequence that required opening and closing of the treating stations in a predetermined sequence and the supply of solution thereto likewise in a similar sequence. The various tanks, piping, valves, pumps and control apparatus of the auxiliary equipment 220 is not illustrated for the sake of clarity. In general, such structural components will be conventional and the plumbing, electrical and control systems per se, likewise, may be conventional elements generally known in the chemical processing field. It will be evident that utilization of a single supply tank at apparatus 220 with a plurality of treating cells 21,22 operating such that processing is taking place in one set of treating cells 21 while the other treating cells 22 are idle, enables the size of the auxiliary equipment 220 to be reduced as compared with prior art treating systems wherein separate supply tanks and control systems are required for each line of treating cells.

Treating station 3 is a water wash station through which all workpieces 10 are moved as they progress through the horizontally arranged treating stations 2–8.

Treating station 4 is an etching station having vertically arranged treating cells 41,42, each having a horizontal row of cells similar to treating station 2 for accommodating multiple workpieces simultaneously. Treating cells 41,42, likewise, are intended to be utilized sequentially in a predetermined cycle for etching multiple workpieces in a high volume processing cycle.

Treating station 4, like station 2, includes its own auxiliary equipment 240 corresponding to equipment 220 associated with treating station 2, except that the liquid solution circulating through the treating cells 200 at station 4 comprise etching solution suitable for surface treating workpieces 10 in preparation for a succeeding treating step. Like auxiliary equipment 220, auxiliary equipment 240 is capable of providing solution to each row of cells 41,42 in a predetermined cycle so that a single row of cells can be supplied with solution while another row is idle.

Treating station 5 comprises another water wash station through which the workpieces travel following processing at station 4 and prior to treatment at treating station 6. At treating station 6, in accordance with this preferred embodiment, the workpieces 10 are electrolytically coated in treating cells 200 constituting vertically arranged treating stations 61,62, each having horizontally arranged multiple treating cells 200. Treating station 6 includes auxiliary equipment 260 that, like auxiliary equipment 220 and 240, includes a solution supply tank, conduits, valves, pumps, and control apparatus for supplying electrolytic solution in proper sequence to treating stations 61,62 to carry out electrolytic plating of workpieces 10.

Treating station 7 comprises a water wash station for cleaning workpieces 10 following their treatment at treating station 6.

Treating station 8 is optional and may comprise a drying unit for the workpieces 10 where the processing of the workpieces is concluded.

Figure 3:
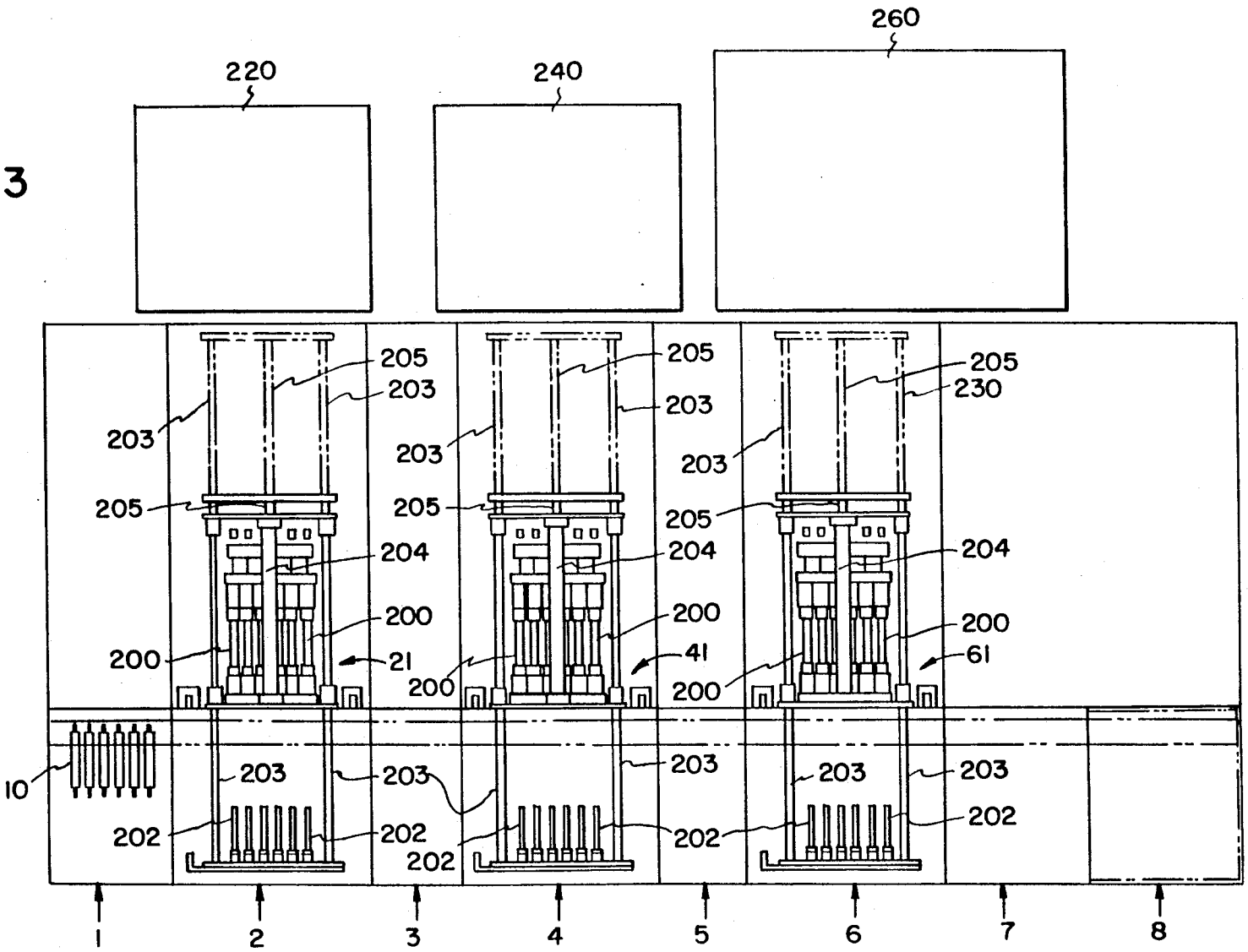
FIG. 3 is a plan view of the system illustrated in FIG. 2.
Figure 4:
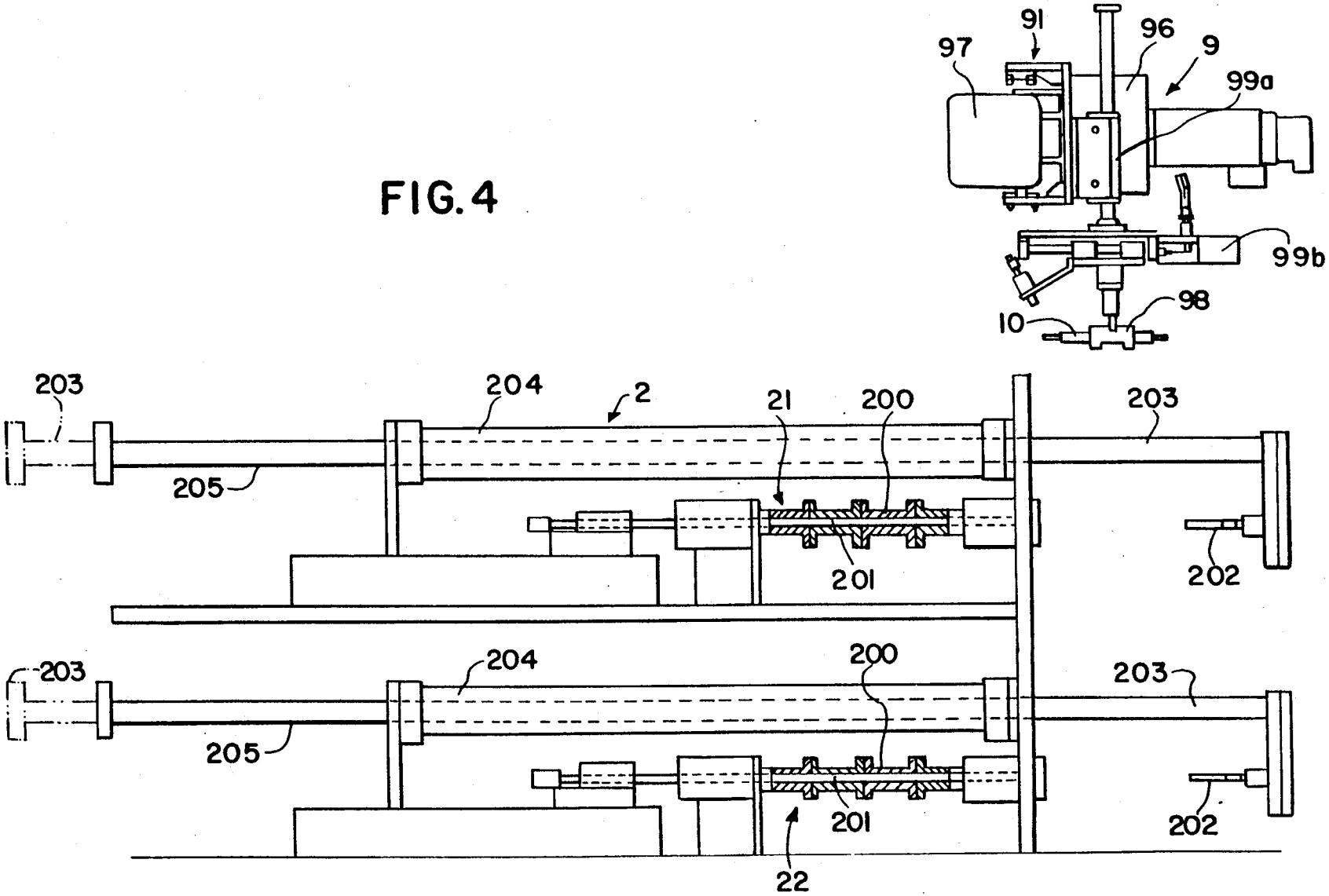
FIG. 4 is an end view of the system illustrated in FIG. 2.

The structural arrangement of the treating stations 1–8 is more clearly evident from viewing FIGS. 3 and 4. As seen in FIG. 3, work stations 2, 4 and 6 are substantially identical in structural arrangement insofar as each station includes vertically arranged treating stations each having a horizontally aligned set of treating cells 200. As will be discussed in more detail below, an overhead conveyor system 9 is provided to transport workpieces 10 from the supply station 1 to each succeeding treating station 2–8. The conveyor system 9 extends along a direction extending parallel to the path of movement of the workpieces 10 as they traverse to the treating stations 2–8. Without describing the details of the conveyor system 9 at this moment, it will be noted that, as illustrated in FIG. 4, the conveyor system 9 will include an arrangement for lowering workpieces 10 vertically into position where they may be engaged by workpiece holding chuck elements 201,202 or other suitable work receiving elements at each of the treating stations 2, 4 and 6. Treating stations 3, 5 and 7, which in this embodiment are water wash stations, may not necessarily include specific work receiving elements, since the workpieces may be deposited directly into a fluid bath on a batch by batch basis.

As seen in FIGS. 3 and 4, one set of the workpiece chucks 201 of station 21 is located at a position ready for engaging a workpiece 10, while the other chuck sets 202 are in a retracted position awaiting receipt of a workpiece 10 from the conveyor system 9. A fluid motor actuator 204 is provided at each of the work stations 2, 4 and 6 for horizontally moving chuck elements 202 of each treating cell via actuating piston rod 205 and carrier rods 203. The horizontal advancing movement is from right to left as viewed in FIG. 4, and retraction is from left to right. With the workpiece 10 placed between chucks 201,202, complete leftward movement of the carrier rod 203 and chucks 201,202 results in placement of the workpiece 10 within the treating cells 200, ready for the treating process to be carried out at the respective treating station.

The conveyor system 9 (see FIGS. 2 and 4) includes overhead conveyor units 91, 92, 93 and 94 arranged to engage and move workpieces 10 to each of the treating stations 2-8. The conveyor units 91-94 are supported by a common rail or beam 97 extending along a path of travel extending parallel to the horizontally spaced treating stations 2-8. Each conveyor unit 91-94 includes workpiece carriers comprising chucks 98 for engaging and grasping workpieces 10. In the specific embodiment illustrated, each conveyor unit workpiece carrier includes six chucks 98 for engaging six workpieces simultaneously and moving them to or from a treating station.

Each conveyor unit 91-94 furthermore includes a vertical actuating cylinder 99*a* and a horizontal (fore and aft) actuating cylinder 99*b*. A drive motor 96 supported by the rail 97 centrally motivates drive shafting 95 associated with the conveyor units 91-94 and the rail 97. The motor 96 drives shafting 95 through an appropriate motion transfer mechanism (i.e., gearing) and shafting 95 is arranged such that the conveyor units 91-94 each may be individually moved along the rail 97 in a predetermined programmed sequence, as will be more fully explained below.

Thus, through appropriate controls over the position of an individual conveyor unit along the rail 97 and precise control of vertical and horizontal actuators 99*a*,99*b*, each workpiece 10 may be precisely positioned in direct alignment with workpiece chucks 201,202 at each treating station in an automated procedure without manual intervention.

The manner in which the conveyor units 91-94 handle workpieces 10 so as to achieve high volume chemical treatment of the workpiece surfaces at the treating stations will now be described. As mentioned at the outset of this description, the objective of the invention is to move workpieces, for example metal workpieces, to be surface treated chemically in high volume from a supply station or supply location into and out of multiple treating stations, in a sequence. This is achieved in accordance with the invention by a workpiece handling system that moves multiple workpieces simultaneously into vertically arranged treating stations in a predetermined sequence such that each treating station can be loaded with and perform its function on the workpiece while another treating station is being loaded. Upon completion of the treating process in the first work station, the workpiece is unloaded from it while the treating process is carried out in the next succeeding work station, and so forth. It is important that efficiency be optimized through the use of a single conveyor for each vertically arranged set of work stations and it is also advantageous to use common auxiliary equipment with a single treating solution supply tank to handle the treating solutions for each vertically arranged group of treating stations.

Figure 5:
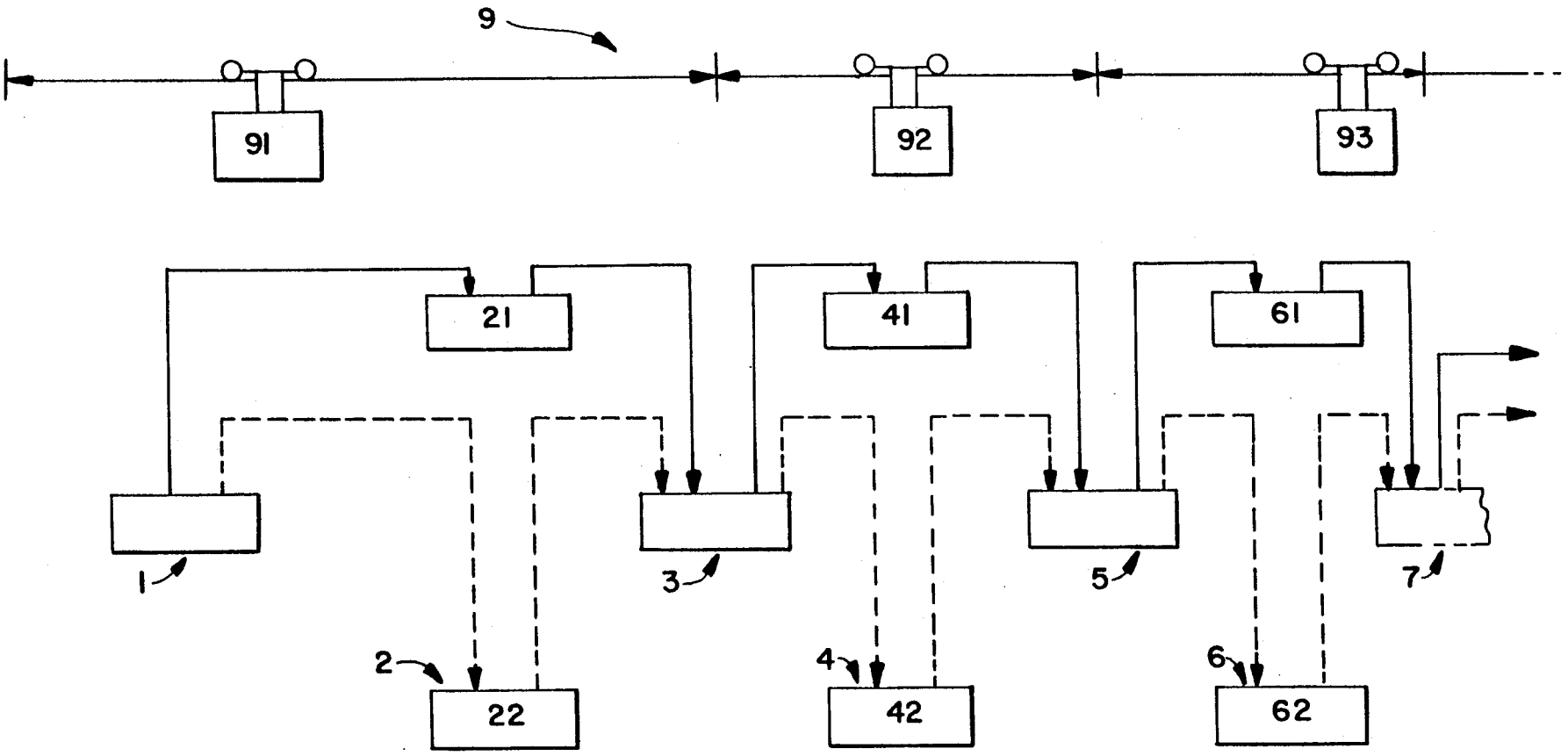
FIG. 5 schematically shows a workpiece handling and treating system and procedure embodying this invention.

More specifically, and with reference to FIG. 5, a typical predetermined cyclic movement pattern of the conveyors 91-94 will be dexcribed. In FIG. 5, only conveyors 91-93 are illustrated, since any additional conveyors would essentially follow the same pattern, and only work stations 2-7 are illustrated for the same reason. To begin the treating procedure, conveyor 91 is moved to a workpiece supply location 1, engages one or more workpieces 10, raises them and moves them generally horizontally to treating station 21. The workpieces are then lowered into alignment with chucks 201,202 (generally referred to as "work receiving means") so that the chucks can engage the workpieces and move them into position horizontally into the treating cells 200 upon actuation of cylinders 204. It will be noted from FIG. 4 that, as the work receiving means of chucks 201,202 of station 21 move horizontally to the left, the lower chucks 201,202 of the lowermost treating station 22 are freely accessible to the overhead conveyor 91. Upon the loading of the first group of workpieces into the work station 21, auxiliary equipment 220 is activated to provide appropriate solution from a supply tank by suitable processing controls to the treating station 21. While station 21 is treating the workpieces therein, the conveyor 91 returns to the supply station 1 and picks up the next load of workpieces which are then conveyed to the lower treating station 22. By this time, the first batch of workpieces have been treated (i.e., degreased) in treating station 21 and conveyor 91 is already in place above the station 21, so that, upon the conclusion of the treating process at station 21, appropriate controls are activated to remove the workpieces 10 from the treating cells 200 by the chucks 201,202, the workpieces are moved horizontally to their initial retracted loading position by the fluid actuating cylinder 204, conveyor 91 engages the first group of workpieces, raises them and moves them generally horizontally to the water bath station 3 for rinsing.

The conveyor 91 then returns empty to the supply location 1 and moves a third group of workpieces to the upper treating station 71, which is now idle and ready to accept the next batch of workpieces. The third batch of workpieces is then processed in cell 21 and by this time the treating process in treating station 22 is completed and the workpieces have been discharged therefrom and held at the ready for pickup by conveyor 91. Conveyor 91 then drops to treating station 22 and moves the second batch of workpieces from station 22 to station 3 for rinsing.

In the meantime, while carrier 91 was moving the third batch of workpieces from the supply location 1 to treating station 21, conveyor 92 was controlled to move to the water bath station 3 to pick up the first batch of workpieces that have been now rinsed. Conveyor 92 then proceeds to move the first batch of workpieces to upper station 41 of station 4 whereat the workpieces are treated (i.e., etched), with auxiliary equipment 240 controlling the timing and flow of etching solution in the treating cells 200 of treating station 41. Lower station 42 meanwhile is open and ready to accept the next batch of workpieces as conveyor 92 returns to the water bath station 3 to pick up the next batch of workpieces.

In the meantime, carrier 91 has returned to the supply location 1 to pick up the fourth batch of workpieces which are then moved to a lower treating station 22 at station 2 while carrier 92 moves the second batch of workpieces from the bath 3 and deposits them at the lower treating station 42. Stations 41 and 42 at location 4 are essentially programmed to handle and process workpieces much in the same manner as the treating stations 21,22 using a single piece of auxiliary equipment that controls the flow of solution and movement of the chucks in both treating stations 41,42.

Continuing the procedure, carrier 91 then removes the third batch of workpieces from cell 21 and deposits them at the water bath station 3 and then returns empty to the supply location 1. In the meanwhile, conveyor 92 has now moved the first batch of workpieces from treating station 41 to the next rinsing water bath station 5 and has returned empty to the rinsing station 3 to pick up the next batch of workpieces to be moved to station 41. After deposit of the workpieces at station 41, conveyor 92 lowers to station 42 to pick up and move the treated batch of workpieces to the next water rinse station 5.

This cyclic pattern of movement of conveyors and work receiving means is repeated down the processing line so that eventually each batch of workpieces is treated at each treating station and eventually discharged from the treating system.

It will be noted that the single overhead conveyor support that is illustrated in this embodiment as an overhead rail 97 guides the conveyors 91–94 for movement, but the movement of the conveyors only overlaps at the intermediate stations 3, 5, 7, etc. which essentially are treating stations that handle each batch of workpieces that have been processed through the treating stations 2, 4 and 6. Through the use of the single conveyors moving workpieces through vertically arranged treating stations each having multiple treating cells, simplicity of construction is achieved while still maintaining a high volume capacity.

While a specific embodiment of the invention has been described as well as a specific procedure for electrolytic plating of metal workpieces involving degreasing, washing, etching and plating the workpieces, it is to be understood that the invention has application in any type of workpiece handling system wherein the workpiece must be moved through a series of treating stations individually or in batches, irrespective of the particular treating process being carried out at each station. The inventive contribution involves the use of a single conveyor to move a workpiece or workpieces sequentially through a series of treating stations in which at least one group of stations is vertically oriented and arranged to receive sequential workpieces or batches of workpieces as the conveyor traverses a workpiece supply location and the treating stations. Further efficiency is realized by using a single supply tank and control system for regulating the supply of treating solution supplied to the treating stations that are arranged as a vertical group of adjacent stations. It will be understood that the invention is not limited to processing workpieces through an electroplating system, but rather involves the broader aspect of handling workpieces that must be chemically or otherwise treated at individual treating stations in a high volume efficient manner. The specific conveyor construction can be varied within the scope of the invention, provided that the cyclic pattern of movement of the conveyor is essentially consistent with the inventive concept herein described. Likewise, the specific construction of the treating stations may be varied within the scope of knowledge of persons skilled in article or material treating apparatus. For example, the work receiving chuck elements could be varied, depending upon the workpiece or article to be processed and the specific manner in which the chucks or work receiving elements are moved horizontally could be varied to accommodate different treating procedures, treating cells and workpieces.

Although the treating stations are illustrated in a linear alignment, the invention is not so limited as long as the treating stations are sequentially disposed in some definite order and accessible to the conveyors for cyclic movement of workpieces in the manner above described. Moreover, while an overhead conveyor support rail is utilized in accordance with the preferred embodiment of the invention, various other conveyor support means could be utilized, provided that the workpieces can be sequentially and cyclically moved from supply locations to treating stations to a next succeeding treating station, all in the manner previously described. It is to be noted that, although only two vertically arranged treating stations are illustrated in the accompanying illustrations at treating stations 2, 4 and 6, any number of vertically arranged treating stations could be utilized, provided that they may be efficiently supplied with treating solution and further provided that the conveyor associate with the work station can handle loading and unloading of the treating stations in proper sequence without undue idle time occurring at any treating station.

Accordingly, although a single embodiment of the invention has been described for illustrative purposes, the scope of the invention is not to be limited except in accordance with the scope of the claims that follow.

1. A workpiece handling and treating system for moving a high volume of workpieces through and treating them sequentially at a plurality of treating stations comprising:

at least a first group of vertically spaced treating stations;

at least one intermediate treating station at least horizontally spaced from said first group of treating stations;

a means for supplying workpieces to be treated at the work treating stations;

a first single conveyor means comprising a single horizontally and vertically moveable workpiece carrier means arranged to move between at least said means for supplying workpieces, said first group of vertically spaced treating stations and said intermediate treating station, to transfer workpieces from said means for supplying workpieces to each treating station of said first group of treating stations and to remove the workpieces from said treating stations of said first group of treating stations and move them to said intermediate treating station, all in accordance with a first predetermined cyclic movement pattern that includes sequentially supplying workpieces to a different one of the vertically spaced treating stations so that each workpiece is treated only at a single one of said vertically spaced treating stations, and subsequently moving each workpiece from its respective treating station to the intermediate treating station.

2. A workpiece handling and treating system as claimed in claim 1, wherein each of said vertically spaced treating stations of said first group of treating stations is arranged to perform the same treatment on a workpiece.

3. A workpiece handling and treatment system as claimed in claim 1, wherein said treating stations are arranged to treat a plurality of workpieces simultaneously and each workpiece carrier means includes means for moving a plurality of workpieces simultaneously to the treating stations.

4. A workpiece handling and treating station as claimed in claim 1, including at least a second group of vertically at least horizontally spaced treating stations spaced from said first group of treating stations, with said intermediate station disposed between said first and second groups of treating stations;

a second single conveyor means comprising a single horizontally and vertically moveable workpiece carrier means arranged to move horizontally between said intermediate treating station and said second group of treating stations and to transfer workpieces from said intermediate treating station to said second group of treating stations in accordance with a second predetermined cyclic movement pattern that includes sequentially moving workpieces from said intermediate treating station to a different one of the vertically spaced treating stations of said second group of vertically spaced treating stations so that each workpiece is treated only at a single one of said vertically spaced treating stations of said second group of treating stations.

5. A workpiece handling and treating system as claimed in claim 4, including a second intermediate treating station spaced from said second group of treating stations, and wherein said second conveyor means is arranged to also move between said second group of treating stations and said second intermeidate treating station, and further wherein said second predetermined pattern of cyclic movement includes motion to remove workpieces sequentially from each of said second group of treating stations and to convey them to said second intermediate treating station.

6. A workpiece handling and treating system as claimed in claim 5, wherein said first and second groups of treating stations are arranged to each perform a different treating operation, and wherein the treating stations of each group of treating stations is arranged to perform the same treating operation.

7. A workpiece handling and treating system as claimed in claim 6, wherein each intermediate treating station is arranged to perform a treating operation different from any treating operation performed by any of said groups of treating stations.

8. A workpiece handling and treating system as claimed in any one of claims 1-3, 4-7 wherein each single conveyor means associated with said or each group or groups of treating stations is spaced vertically away from the treating stations of the or each group, and wherein at least the treating station most closely adjacent the single conveyor means associated with a respective group of treating stations includes horizontally movable first work receiving means for receiving and horizontally moving a workpiece after a workpiece has been conveyed to said most closely adjacent treating station;

a next adjacent treating station of the or each group of treating stations, said next adjacent treating station having second work receiving means for receiving workpieces conveyed to said next adjacent treating station by said associated single conveyor means;

said first work receiving means being disposed between said conveyor means and said work receiving station of said next adjacent treating station when disposed in a work receiving position, and being horizontally movable to another position to provide direct access to the work receiving station of the next adjacent treating station by said single conveyor means.

9. A workpiece handling and treating system as claimed in any one of claims 1-3, 4-7, wherein at least said group or groups of treating stations includes liquid treating cells;

a single liquid solution supply means associated with the or each group of treating stations for supplying liquid treating solution used in the treating cells of the associated treating stations;

means for cyclically supplying each of said cells of each of the treating stations of a group of treating stations one at a time from the single liquid solution supply means.

10. A workpiece handling and treating system as claimed in claim 8, wherein at least said group or groups of treating stations includes liquid treating cells;

a single liquid solution supply means associated with the or each group of treating stations for supplying liquid treating solution used in the treating cells of the associated treating stations;

means for cyclically supplying each of said cells of each of the treating stations of a group of treating stations one at a time from the single liquid solution supply means.

11. A workpiece handling and treating system as claimed in any one of claims 1-3, 4-7, wherein said group or at least one of said groups of treating stations comprises electrolytic coating cells.

12. A workpiece handling and treating system as claimed in claim 8, wherein said group or at least one of said groups of treating stations comprises electrolytic coating cells.

13. A workpiece handling and treating system as claimed in any one of claims 4-7, wherein said groups of treating cells comprise at least a group of degreasing cells, a group of etching cells and a group of electrolytic plating cells and wherein each intermediate treating station comprises a water wash station.

14. A workpiece handling and treating system as claimed in claim 8, wherein at least said group or groups of treating stations includes liquid treating cells;

a single liquid solution supply means associated with the or each group of treating stations for supplying liquid treating solution used in the treating cells of the associated treating stations;

means for cyclically supplying each of said cells of each of the treating stations of a group of treating stations one at a time from the single liquid solution supply means.

15. A workpiece handling and treating system as claimed in claim 8, including at least one fluid motor actuator means for moving the first work receiving means linearly and horizontally.

16. A workpiece handling and treating system as claimed in claim 15, including at least one fluid motor actuator for moving the second work receiving means linearly and horizontally parallel to the movement of the first work receiving means.

17. A workpiece handling and treating system as claimed in claim 4, including a common conveyor support means for supporting said first and second single conveyor means.

18. A workpiece handling and treating system as claimed in claim 8, including a common conveyor support means for supporting said first and second single conveyor means.

19. A method for high volume handling and treating a series of workpieces at a plurality of treating stations, comprising:

providing a source of workpieces at a supply location;

providing a series of generally horizontally spaced workpiece treating stations including at least one group of vertically spaced treating cells comprising a first treating station;

using a single first workpiece handling conveyor and carrier, sequentially grasping and moving a first workpiece to be treated from said supply location to a first treating cell of said first treating station, then moving a second workpiece to be treated from the supply location to a second treating cell vertically spaced from the first treating cell of the first treating station; then moving the first workpiece from the first treating cell of the first treating station to a second treating station; then moving a third workpiece from the supply location to the first treating cell of the first treating station; then moving the second workpiece from the second cell of the first treating station to the second treating station; then moving a fourth workpiece from the supply location to the second cell of the first treating station, and repeating all the foregoing recited conveyor movements in cyclic sequence to move subsequent workpieces through the first and second treating stations.

20. A method for high volume handling and treating a series of workpieces as claimed in claim 19, including providing a third workpiece treating station comprising a group of vertically spaced treating cells and a fourth workpiece treating stations;

using a single second workpiece handling conveyor and carrier, while the first conveyor is moving the third workpiece from the supply location to the first treating cell of the first treating station, moving the first workpiece from the first treating station to a first cell of the third treating station; then, while the first conveyor is moving the fourth workpiece to the second cell of the first treating station, moving the second workpiece by the second conveyor from the second treating station to the second cell of the third treating station; then, while the first conveyor is moving a fifth workpiece from the supply location to the first treating cell of the first station, moving the first workpiece by the second conveyor to the fourth treating station; then, while the first conveyor is moving the fifth workpiece from the first treating cell of the first treating station to the second treating station, using the second conveyor to move the second workpiece from the second treating station to the fourth treating station, and thereafter sequentially repeating the above recited conveyor movements in cyclic sequence to move workpieces through the four treating stations.

21. The method for high volume handling and treating a series of workpieces as claimed in claim 19 or 20, wherein each work handling conveyor moves workpieces vertically towards the treating cell or cells of each treating station, and including moving each workpiece horizontally after it is supplied to a respective treating cell to clear access between the respective conveyor moving workpieces to the cell and a vertically lower treating cell of the same treating station.

22. The method for high volume handling and treating a series of workpieces as claimed in claim 20, including locating all the treating stations along a single path of workpiece movement, and supporting each conveyor for movement along a limited portion only of the single path of workpiece movement, with the portions of movement of the conveyors overlapping only at said second and fourth treating stations, including the step of driving the conveyors and carriers for movement in a manner to avoid their simultaneous overlapping movement at said second and fourth treating stations.

23. A method for high volume handling and treating a series of workpieces as claimed in claim 19 or 20, including carrying out liquid chemical surface treatment of metal workpieces at least at the vertically spaced treating cells.

24. A method for high volume handling and treating a series of workpieces as claimed in claim 19 or 20, wherein the treating cells are arranged to perform liquid chemical surface treatment of workpieces using a chemical solution within a container, including the step of supplying chemical solution from a single solution supply source to each container of the treating cells one at a time contemporaneously with the moving of a workpiece to the respective treating station.

* * * * *